United States Patent [19]

Farrell

[11] 4,424,115

[45] Jan. 3, 1984

[54] SELECTIVE REMOVAL AND RECOVERY OF AMMONIA AND HYDROGEN SULFIDE

[75] Inventor: Thomas R. Farrell, Hercules, Calif.

[73] Assignee: Shionogi & Co., Ltd., Osaka, Japan

[21] Appl. No.: 366,894

[22] Filed: Apr. 9, 1982

[51] Int. Cl.[3] ..... C10G 53/00; C10G 69/02; C01C 1/12

[52] U.S. Cl. ..... 208/89; 208/212; 208/210; 55/70

[58] Field of Search ..... 208/210, 212, 89; 55/70, 73

[56] References Cited

U.S. PATENT DOCUMENTS

| | | | |
|---|---|---|---|
| 3,335,071 | 8/1967 | Bollen et al. | 203/85 |
| 3,340,182 | 9/1967 | Berkman et al. | 208/212 |
| 3,365,374 | 1/1968 | Short et al. | 203/42 |
| 3,404,072 | 10/1968 | Bollen et al. | 203/1 |
| 3,600,283 | 8/1971 | Bollen et al. | 203/1 |
| 4,002,565 | 1/1977 | Farrell et al. | 210/60 |

*Primary Examiner*—Delbert E. Gantz
*Assistant Examiner*—O. Chaudhuri
*Attorney, Agent, or Firm*—Wenderoth, Lind & Ponack

[57] ABSTRACT

A hydrocarbon material is subjected to mild hydrotreatment, washed, subjected to severe hydrotreatment and washed with only enough water to absorb all of the $H_2S$ but only a fraction of the $NH_3$ present in the hydrocarbon material. The effluent streams from each step of this process are segregated so that each may be fed separately to the optimum section of the recovery process. The washed hydrotreated hydrocarbon material is separated from the second effluent stream, and then a vapor phase is separated from the hydrocarbon material in a high pressure separator. The vapor phase is scrubbed with water to form an aqueous solution of $NH_3$ with only a minor amount of $H_2S$ (an $NH_3$ to $H_2S$ ratio of at least 6:1).

2 Claims, 2 Drawing Figures

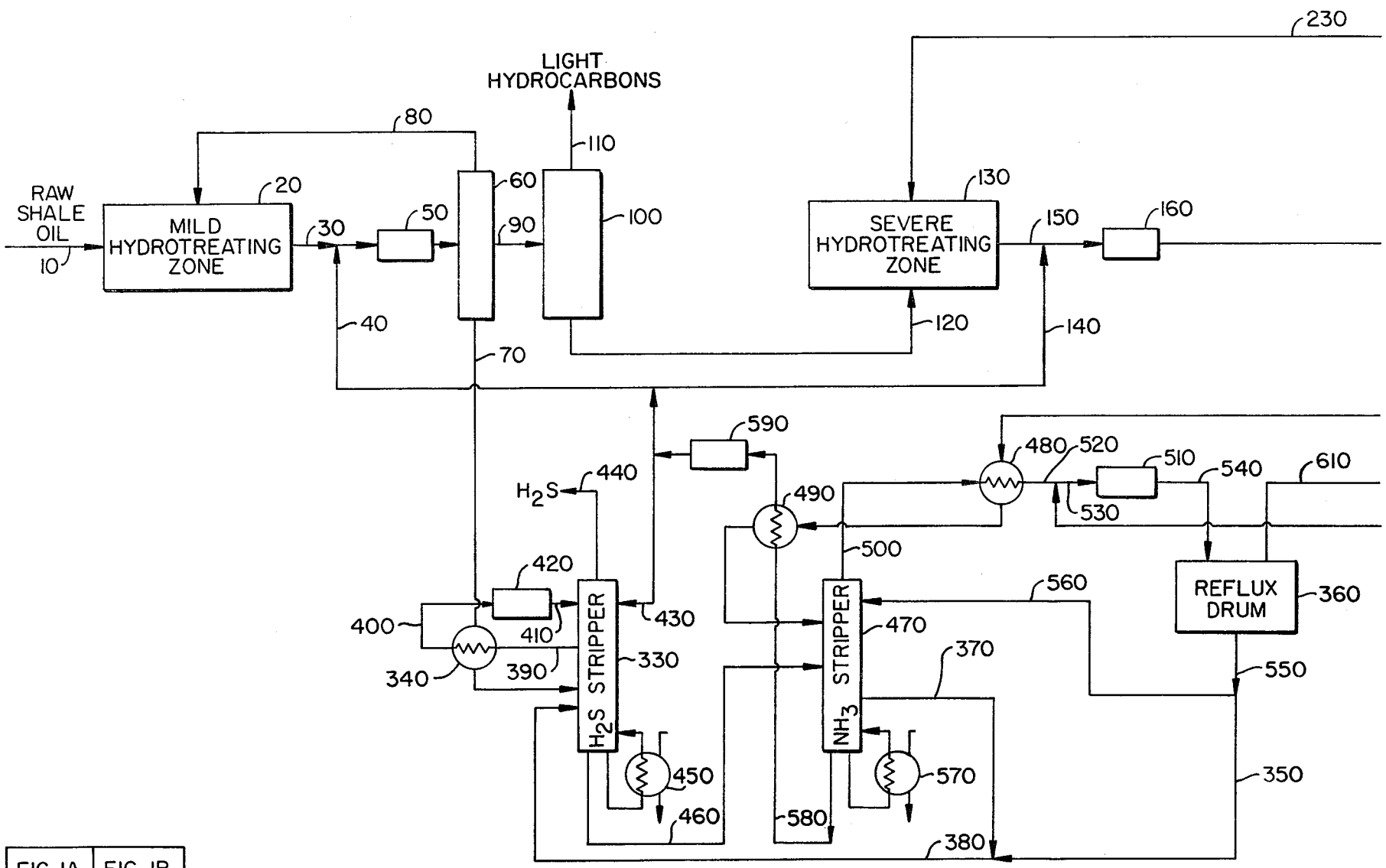
FIG. IA.
FIG. IA. | FIG. IB.
FIG. I.

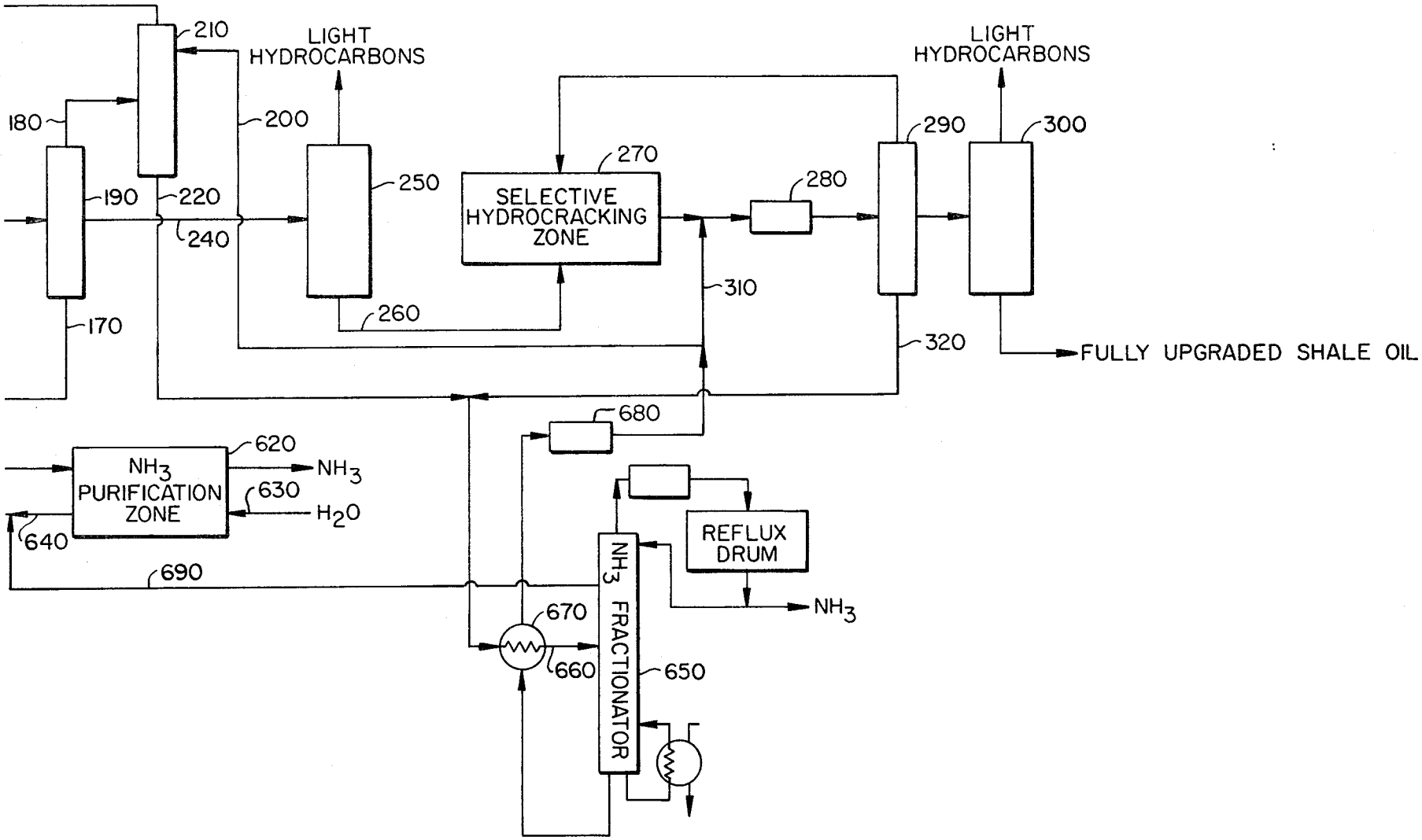
FIG._IB.

SELECTIVE REMOVAL AND RECOVERY OF AMMONIA AND HYDROGEN SULFIDE

BACKGROUND OF THE INVENTION

Hydrocarbon oils derived from petroleum and similar sources contain varying amounts of nitrogen compounds and sulfur compounds. In the course of refining the oils it is often desirable to remove such compounds because they impart undesired properties such as disagreeable odor, corrosivity, poor color, and the like to saleable products. In addition, the compounds may have deleterious effects in various catalytic refining processes applied to oils, the nitrogen compounds in particular deactivating certain hydrocracking catalysts and tending to cause excessive gas and coke production in cracking processes. Various schemes have been devised for removing the nitrogen and sulfur compounds from oils, probably the most common and best suited process being catalytic hydrofining wherein the nitrogen and sulfur compounds are converted to $NH_3$ and $H_2S$ by reaction with hydrogen, usually promoted by the use of elevated temperatures and pressures and hydrogenation catalysts. Similar reactions of the nitrogen and sulfur compounds with hydrogen to form $NH_3$ and $H_2S$ also occur in other processes such as thermal and catalytic cracking, reforming, and hydrocracking, which are not specifically designed for this purpose. There are thus produced various reaction effluents containing $NH_3$ and $H_2S$.

The removal of $NH_3$ and $H_2S$ from such hydrocarbon reaction effluent streams may be accomplished by scrubbing with water, preferably at elevated pressure and low temperature. To obtain the desired extent of removal, however, it is often necessary to use a large amount of water so that a dilute aqueous solution of $NH_3$ and $H_2S$ is formed. This sour water generally has to be treated to remove the $NH_3$ and $H_2S$ before the water can be discharged under an NPDES permit.

In a typical prior art process for the upgrading of raw shale oil, the oil is subjected to mild hydrotreating conditions in order to remove the reactive metallic organic compounds commonly found in shale oil, for example: iron, arsenic, nickel, and vanadium. These compounds deposit on hydrotreating catalysts and eventually cause the catalyst to lose its hydrotreating activity. Moreover, the contaminated catalyst is not economically regenerable. As a result, the catalyst of choice is usually a low-cost, high-metal-capacity catalyst which is inherently unsuitable for the severe hydrotreating ultimately needed for complete upgrading of shale oil. Therefore, this mild hydrotreating is only the first step in the overall process. In the second step, a high activity catalyst is used at severe hydrotreating conditions to convert the shale oil nitrogen to $NH_3$. This catalyst need not be able to withstand metallic compounds since they are essentially removed in the first step; the catalyst formulations can thus be optimized for nitrogen conversion. In one prior art process, the shale oil is subjected to a third step of upgrading in which waxy compounds are preferentially hydrocracked by means of a shape-selective catalyst in order to reduce the pour point of the shale oil.

Each of these prior art upgrading steps produces some $NH_3$ and $H_2S$ from the nitrogen and sulfur compounds contained in the shale oil. As described previously, the $NH_3$ and $H_2S$ are removed from the reaction effluent streams by scrubbing with water at elevated pressure and low temperature to form dilute aqueous solutions of $NH_3$ and $H_2S$ called sour water. In a typical prior art recovery process, these sour water streams are combined and fed to interconnected distillation columns operated at superatmospheric pressures wherein the $NH_3$ and $H_2S$ are recovered separately by stripping distillation.

$H_2S$ vapors are withdrawn overhead from one column ($H_2S$ stripper), and the bottoms from that column is passed to another column ($NH_3$ stripper) where $NH_3$ vapors are recovered by partially condensing the overhead vapors and recycling a portion of the condensate to the first column. Purified water is withdrawn as bottoms from the second column. This process works well for recovering $NH_3$ and $H_2S$ from petroleum-derived effluent streams where the $NH_3$ to $H_2S$ weight ratio is typically 0.5, but, when the effluent stream has a high $NH_3$ to $H_2S$ ratio (such as found in effluent streams from shale oil hydrotreating), ammonia levels further build up in the $H_2S$ stripper column feed due to the ammonia in the recycle condensate stream. This further increase of the $NH_3$ to $H_2S$ ratio exacerbates an already difficult removal of $H_2S$ in the $H_2S$ stripper column and at a certan feed $NH_3$ to $H_2S$ ratio, the removal of $H_2S$ becomes unfeasible.

SUMMARY OF THE INVENTION

The present invention overcomes the deficiencies of the prior art by treating each effluent stream separately. The effluent stream from the mild hydrotreating step is treated by a waste water process wherein the hydrogen sulfide stripper precedes the ammonia stripper, but the effluent stream from the severe hydrotreating step is treated by a waste water process wherein the ammonia stripper precedes the hydrogen sulfide stripper.

In this process, a hydrocarbon material is subjected to mild hydrotreatment in the presence of hydrogen. During this mild hydrotreatment, some of the nitrogen present in the hydrocarbon material is converted to ammonia, and some of the sulfur present in the hydrocarbon material is converted to hydrogen sulfide. The hydrotreated hydrocarbon material is then washed to form a washed hydrotreated hydrocarbon material oil and a first effluent stream comprising water, ammonia and hydrogen sulfide, then the washed hydrotreated hydrocarbon material is separated from the first effluent stream. The washed hydrotreated hydrocarbon material is subjected to severe hydrotreatment in the presence of hydrogen, wherein most of the nitrogen remaining in the hydrocarbon material is converted to ammonia, and wherein most of the sulfur remaining in the hydrocarbon material is converted to hydrogen sulfide. The hydrotreated hydrocarbon material is then washed with only enough water to absorb the bulk of the hydrogen sulfide but only a fraction of the ammonia present in the hydrocarbon material, thereby forming a washed hydrotreated hydrocarbon material containing a vapor phase which contains ammonia and a minor amount of $H_2S$, and a second effluent stream comprising water, ammonia and hydrogen sulfide. Then the washed hydrotreated hydrocarbon material is separated from the second effluent stream, and the vapor phase present in the washed hydrotreated hydrocarbon material is separated from the washed hydrotreated hydrocarbon material in a high pressure separator, producing a liquid hydrotreated hydrocarbon material and a vapor phase. The vapor phase is scrubbed with water to form an aqueous solution of $NH_3$ having an $NH_3$ to $H_2S$ ratio of at least 6:1. The first effluent stream is stripped in a hydrogen sulfide stripper, with an overhead vapor comprising hydrogen sulfide essentially free of ammonia being withdrawn in one stream, and a bottoms liquid comprising water, hydrogen sulfide and ammonia being withdrawn in another stream. The bottoms liquid is added to the second effluent stream and the second effluent stream is then stripped in an ammonia stripper, with an overhead vapor comprising water, hydrogen sulfide and ammonia being withdrawn in one stream, and a bottoms liquid comprising stripped water being withdrawn in another stream. The overhead vapor from the ammonia stripper is partially condensed to form an uncondensed portion comprising ammonia vapors substantially free of hydrogen sulfide and water, and a condensed portion comprising water, hydrogen sulfide and ammonia. Part of the condensed portion is returned to the ammonia stripper and another part of the condensed portion is recycled to the hydrogen sulfide stripper.

BRIEF DESCRIPTION OF THE DRAWINGS

In order to facilitate the understanding of this invention, reference will now be made to the appended drawing of a preferred embodiment of the present invention. The drawings should not be construed as limiting the invention but are exemplary only.

The drawings are a process diagram of one preferred embodiment of the present invention.

DESCRIPTION OF THE PREFERRED EMBODIMENTS

In the broadest application of the present invention, the effluent streams from each step of a hydrocarbon material upgrading process are segregated so that each may be fed separately to the optimum section of the recovery process. To the second effluent stream of this process, only enough water is added to absorb the bulk of the $H_2S$ but only a fraction of the $NH_3$ present in the hydrocarbon material. Then the effluent stream is separated from the hydrocarbon material and then a vapor phase is separated from the hydrocarbon material. The vapor phase is scrubbed with water to form an aqueous solution of ammonia having an $NH_3$ to $H_2S$ ratio of least 6:1.

The term "stripping" is used herein to characterize the distillation or fractionation as carried out by passing hot vapors or gas generated or introduced at the bottom of multiple-stage contacting columns upward through descending liquid, whereby the concentration of the most volatile component in the liquid decreases during its descent. The distillation zone comprises one or more such columns and appurtenances conventionally associated therewith.

The operation of the process will now be explained with reference to the drawings, illustrating a preferred embodiment of the invention. In this embodiment, raw shale oil containing about 21,000 parts nitrogen, 6,000 parts sulfur, and 100 parts of combined metals (iron, arsenic, and nickel) per million parts shale oil is passed through inlet pipe 10 to a mild hydrotreating zone 20 for the primary purpose of reducing the metal content to about 5 parts or less. The metals are deposited on the catalyst and ultimately cause its replacement. In the course of the metal removal reactions, about 2,100 parts by weight nitrogen (about 10%) and about 4,000 parts sulfur (about 67%) are also converted to $NH_3$ and $H_2S$, respectively. A modest amount of scrubbing water (about 2 gallons per barrel of shale oil) is injected into the reactor effluent line 30 via line 40 for the purpose of absorbing the $NH_3$ and $H_2S$ formed and thereby effecting their removal in an aqueous solution via line 70 from HP separator 60 after cooling in cooler 50. This solution contains about 5.1 wt. % $NH_3$ and 8.5 wt. % $H_2S$. Hydrogen rich gas is recycled to hydrotreating zone 20 via line 80. This gas is substantially free of $NH_3$ and $H_2S$ because they are co-absorbed into the scrubbing water in nearly equal molar quantities. The liquid hydrocarbon phase leaves the HP separator 60 via line 90 to stripping zone 100 where light hydrocarbons are removed via line 110 to yield demetallized shale oil in line 120 which contains about 18,900 parts by weight nitrogen and 2,000 parts sulfur per million parts shale oil.

The demetallized shale oil is passed to severe hydrotreating zone 130 for the primary purpose of reducing the nitrogen content to about 1,000 parts or less. The catalyst used in this zone can be highly optimized for nitrogen removal by virtue of the nearly complete metal removal in the prior mild hydrotreating zone. In the course of the nitrogen removal reactions, the sulfur content is also reduced to about 100 parts or less. In an essential step of the present invention, a limited amount of scrubbing water (about 2 gallons per barrel of shale) is added via line 140 to reactor effluent in line 150 for the purpose of absorbing only enough $NH_3$ to assure bulk co-absorption of the $H_2S$. Thus, after cooling in cooler 160 and withdrawal of the sour water in line 170, the remaining vapor phase in line 180 leaving HP separator 190 contains only about 3% of the $H_2S$ formed in the hydrotreating zone. The sour water in line 170 contains about 18 wt. % $NH_3$ and 4.2 wt. % $H_2S$ when the recycle gas rate in line 180 is about 11 thousand standard cubic feet per barrel of shale oil and when the pressure in HP separator 190 is about 2,000 psia. The recycle gas in line 180 contains about 0.8 mole % $NH_3$ and 0.02 mole % $H_2S$. The $NH_3$ and $H_2S$ are removed by countercurrent contact with scrubbing water from line 200 in absorber 210. When the scrubbing water rate in line 200 is about 6 gallons per barrel of shale oil, the $NH_3$ content of the recycle gas can be reduced by about 97% with three ideal stages of contact in absorber 210 which is operated at about 140° F. This operation would result in about 8.5 wt. % $NH_3$ and 0.4 wt. % $H_2S$ in the solution in line 220 and about 0.024 mole % $NH_3$ and nil $H_2S$ in the recycle gas in line 230. The liquid hydrocarbon phase leaves the HP separator 190 via line 240 to stripping zone 250 where light hydrocarbons are removed to yield shale oil in line 260 which contains about 1000 parts by weight or less nitrogen and 100 parts or less sulfur per million parts shale oil.

In many cases, this may be the full extent of shale oil upgrading prior to further treatment in a conventional petroleum refinery after transport via pipeline. In some cases, however, the shale oil may undergo a third step of upgrading to reduce its pour point and thereby reduce the cost of pipelining. In this case, the shale oil is processed in selective hydrocracking zone 270, cooler 280, HP separator 290, and stripping zone 300 in a method analogous to the previous two upgrading steps. Scrubbing water can be added via line 310 as shown to absorb the additional $NH_3$ and $H_2S$ formed and then remove them via solution in line 320. Alternatively, the $NH_3$ and $H_2S$ can be removed by water absorption within stripping zone 300.

All of the above description may be referred to as the shale upgrading and $NH_3$ and $H_2S$ removal portion of the invention. The description which follows below can be referred to as the $NH_3$ and $H_2S$ recovery portion. A key part of the invention is keeping the various sour water streams which are generated in the removal portion segregated such that each can be fed to the recovery portion at its own optimal point.

The sour water in line 70 has an $NH_3$ to $H_2S$ ratio of about 0.6 and is optimally fed to a midpoint of the $H_2S$ stripper 330 after preheating in exchanger 340. A recycle stream in line 350 from the reflux drum 360 joins with dilution water from line 370 and is fed via line 380 to a low point in $H_2S$ stripper 330 since the $NH_3$ to $H_2S$ ratio is about 3.0. Pumparound reflux in lines 390, 400, and 410 is cooled in exchanger 340 and cooler 420 and returned to the upper part of $H_2S$ stripper 330. Cold scrubbing water is added to the top of $H_2S$ stripper 330 via line 430 to reduce the $NH_3$ content of the $H_2S$ product in line 440 to about 200 ppm or less. Heat for distillation is added to $H_2S$ stripper 330 via reboiler 450 which is preferably heated with steam. Preferred operating conditions for the $H_2S$ stripper 330 are as follows:

Pressure, psia: 100 to 400
Bottom temperature, °F.: 300 to 400
Overhead temperature, °F.: 60 to 120

The $NH_3$ to $H_2S$ ratio of the $H_2S$ stripper bottoms is raised to between 5 and 10 to 1 by virtue of the $H_2S$ removed overhead. As noted in the prior art, complete separation of the $H_2S$ from an aqueous solution containing $NH_3$ is not possible, even at temperatures as high as 450° F. $H_2S$ stripper bottoms is passed via line 460 to $NH_3$ stripper 470. Sour water in line 170 with an $NH_3$ to $H_2S$ ratio of about 4.3 is also fed to $NH_3$ stripper 470 after preheating in exchangers 480 and 490. Overhead vapor in line 500 is partially condensed in exchanger 480 and condenser 510 and flows to reflux drum 360 via lines 520, 530 and 540. The condensed liquid in line 550 contains about 50 wt. % $NH_3$ and 16.5 wt. % $H_2S$. Some of the condensed liquid is returned via line 560 as reflux to $NH_3$ stripper 470 and the balance recycles to $H_2S$ stripper 330 via line 350 after dilution with water from line 370. Heat for distillation is added to $NH_3$ stripper 470 via reboiler 570 which is preferably heated with steam. Preferred operating conditions for the $NH_3$ stripper are as follows:

Pressure, psia: 50 to 100
Bottom temperature, °F.: 280 to 330
Overhead temperature, °F.: 220 to 270
Reflux drum temperature, °F.: 90 to 150

$NH_3$ stripper bottoms in line 580 will contain less than 1000 ppm each of $NH_3$ and $H_2S$ preferably less than 100 ppm each. This stripped water is cooled in exchanger 490 and cooler 590 and then may be used as scrubbing water as follows:

Mild hydrotreating zone effluent via line 40
Severe hydrotreating zone effluent via line 140
$H_2S$ stripper top reflux via line 430

Vapor leaving the reflux drum 360 via line 610 contains about 96% $NH_3$ and minor amounts of $H_2S$ and water. This vapor is fed to $NH_3$ purification zone 620 where additional scrubbing water in line 630 is used to remove the $H_2S$ and recycle it via line 640 and eventually lines 550, 350, and 380 to the $H_2S$ stripper 330.

Sour water in line 220 is fed to $NH_3$ fractionator 650 via line 660 after joining with sour water from line 320 and preheating in exchanger 670. The $NH_3$ fractionator 650 is a conventional reboiled and refluxed distillation column operated as follows to give essentially pure liquid $NH_3$ overhead and purified water as bottoms:

Pressure, psia: about 215
Reflux temperature, °F.: about 100
Bottoms temperature, °F.: about 390

Bottoms is used as scrubbing water in absorber 210 and effluent from selective hydrocracking zone 270 after cooling in exchanger 670 and cooler 680. A small liquid sidedraw is taken via line 690 to return $H_2S$ to $H_2S$ stripper 330 via lines 550, 350 and 380.

While the present invention has been described with reference to specific embodiments, this application is intended to cover those changes and substitutions which may be made by those skilled in the art without departing from the spirit and scope of the appended claims.

What is claimed is:

1. A method of treating a hydrocarbon material containing sulfur and nitrogen comprising:

(a) subjecting said hydrocarbon material to mild hydrotreating, wherein a portion of the nitrogen present in the hydrocarbon material is converted to ammonia, wherein a portion of the sulfur present in the hydrocarbon material is converted to hydrogen sulfide and wherein the metal content of the hydrocarbon material is reduced;
(b) washing said hydrotreated hydrocarbon material to form a demetallized oil and a first effluent stream comprising water, ammonia, and hydrogen sulfide;
(c) separating said demetallized oil from said first effluent stream;
(d) hydrotreating said demetallized oil in the presence of hydrogen, wherein most of the nitrogen remaining in the demetallized oil is converted to ammonia, and wherein most of the sulfur remaining in the demetallized oil is converted to hydrogen sulfide;
(e) washing said hydrotreated demetallized oil with only enough water to absorb the bulk of the hydrogen sulfide but only a fraction of the ammonia; thereby forming a washed hydrotreated demetallized oil containing ammonia and hydrogen sulfide in a vapor phase, and a second effluent stream comprising water, ammonia and hydrogen sulfide;
(f) separating said washed hydrotreated demetallized oil from the second effluent stream, and separating a vapor phase from said washed hydrotreated demetallized oil in a high pressure separator;
(g) scrubbing said vapor phase with water to produce an aqueous solution of ammonia having an ammonia to hydrogen sulfide ratio of at least 6:1;
(h) stripping said first effluent stream in a hydrogen sulfide stripper;
(i) withdrawing overhead vapor from said hydrogen sulfide stripper, said vapor comprising hydrogen sulfide essentially free of ammonia;
(j) withdrawing bottoms liquid from said hydrogen sulfide stripper, said liquid comprising water, hydrogen sulfide, and ammonia;
(k) adding said bottoms liquid to said second effluent stream;
(l) stripping said second effluent stream in an ammonia stripper;
(m) withdrawing overhead vapor from said ammonia stripper, said vapor comprising water, hydrogen sulfide, and ammonia;
(n) withdrawing bottoms liquid from said ammonia stripper, said liquid comprising stripped water;
(o) partially condensing said overhead vapor from said ammonia stripper to form an uncondensed portion comprising ammonia vapors substantially free of hydrogen sulfide and water, and a condensed portion comprising water, hydrogen sulfide, and ammonia;

(p) returning a part of said condensed portion to said ammonia stripper; and (q) recycling another part of said condensed portion to said hydrogen sulfide stripper.

2. A method of treating a hydrocarbon material according to claim 1 wherein said washed hydrotreated demetallized oil of step (f) is further subjected to hydrocracking.

* * * * *

UNITED STATES PATENT AND TRADEMARK OFFICE

CERTIFICATE OF CORRECTION

PATENT NO. : 4,424,115

DATED : January 3, 1984

INVENTOR(S) : Thomas R. Farrell

It is certified that error appears in the above-identified patent and that said Letters Patent is hereby corrected as shown below:

On the title page assignee should read:

--(73) Assignee: Chevron Research Company, San Francisco, California --.

Column 2, line 24, "certan" should read -- certain --.

Signed and Sealed this

*Twenty-first* Day of *May 1985*

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,424,115

DATED : January 3, 1985

INVENTOR(S) : THOMAS R. FARRELL

It is certified that error appears in the above-identified patent and that said Letters Patent are hereby corrected as shown below:

On the title page;

Attorney, Agent, or Firm, "Wenderoth, Lind & Ponack" should read --D. A. Newell, S. R. LaPaglia, & E. A. Schaal--

Signed and Sealed this

*Eighth* Day of *October 1985*

[SEAL]

*Attest:*

DONALD J. QUIGG

*Attesting Officer*

*Commissioner of Patents and Trademarks—Designate*